US011144080B2

(12) United States Patent
Kudva et al.

(10) Patent No.: US 11,144,080 B2
(45) **Date of Patent: *Oct. 12, 2021**

(54) SWITCHED LOW-DROPOUT VOLTAGE REGULATOR

(71) Applicant: NVIDIA Corp., Santa Clara, CA (US)

(72) Inventors: Sudhir Kudva, Dublin, CA (US); John Wilson, Wake Forest, NC (US)

(73) Assignee: NVIDIA Corp., Santa Clara, CA (US)

( * ) Notice: Subject to any disclaimer, the term of this patent is extended or adjusted under 35 U.S.C. 154(b) by 40 days.

This patent is subject to a terminal disclaimer.

(21) Appl. No.: 16/723,700

(22) Filed: Dec. 20, 2019

(65) Prior Publication Data

US 2020/0264642 A1 Aug. 20, 2020

Related U.S. Application Data

(63) Continuation of application No. 16/135,977, filed on Sep. 19, 2018, now Pat. No. 10,558,230.

(60) Provisional application No. 62/628,927, filed on Feb. 9, 2018.

(51) Int. Cl.

| | |
|---|---|
| ***G05F 1/42*** | (2006.01) |
| ***G05F 1/46*** | (2006.01) |
| ***G05F 1/563*** | (2006.01) |
| ***G05F 1/565*** | (2006.01) |
| ***G05F 1/575*** | (2006.01) |

(52) U.S. Cl.

CPC ..... *G05F 1/462* (2013.01); *G05F 1/563* (2013.01); *G05F 1/565* (2013.01); *G05F 1/575* (2013.01)

(58) Field of Classification Search

CPC ..... G05F 1/462; G05F 1/563; G05F 1/565; G05F 1/575

See application file for complete search history.

(56) References Cited

U.S. PATENT DOCUMENTS

| | | | | |
|---|---|---|---|---|
| 6,856,124 | B2 * | 2/2005 | Dearn | G05F 1/575 323/273 |
| 7,511,560 | B2 | 3/2009 | Yen et al. | |
| 8,294,442 | B2 * | 10/2012 | Zhu | G05F 1/575 323/281 |
| 8,716,993 | B2 | 5/2014 | Kadanka | |
| 10,234,881 | B1 * | 3/2019 | Goyal | G05F 1/565 |
| 2014/0159683 | A1 * | 6/2014 | Pan | G05F 1/575 323/280 |
| 2014/0277812 | A1 * | 9/2014 | Shih | G05F 1/563 700/298 |
| 2016/0282889 | A1 * | 9/2016 | Mahajan | G05F 1/575 |
| 2019/0079551 | A1 * | 3/2019 | Tourret | G05F 1/571 |

* cited by examiner

*Primary Examiner* — Kyle J Moody
(74) *Attorney, Agent, or Firm* — Rowan TELS LLC

(57) ABSTRACT

High-resolution switched digital regulators are disclosed having fast cross corner and variable temperature response, with constrained ripple. The strength of the power transistors utilized by the regulator are adjusted to control the current delivered to the load. The regulators utilize a slow control loop in parallel with a primary fast switching loop. The slow loop uses the switching signal of the primary loop to estimate the load current and set the power transistor size accordingly.

9 Claims, 19 Drawing Sheets

SWITCHED LOW-DROPOUT VOLTAGE REGULATOR

CROSS REFERENCE TO RELATED APPLICATIONS

This application claims priority and benefit under 35 USC 120 as a continuation of U.S. application Ser. No. 16/135,977, titled "SWITCHED LOW-DROPOUT VOLTAGE REGULATOR", filed on Sep. 19, 2018, the contents of which are incorporated herein by reference in their entirety. Application Ser. No. 16/135,977 claims priority and benefit under 35 U.S.C. 119(e) to U.S. Application Ser. No. 62/628,927, filed on Feb. 9, 2018, the contents of which are incorporated herein by reference in their entirety.

GOVERNMENT LICENSE RIGHTS

This invention was made with US Government support under Lawrence Livermore National Laboratory subcontracts B609911 and B609487 awarded by DOE. The US Government has certain rights in this invention.

BACKGROUND

As process technology advances to lower dimensions, it is becoming more complicated to design analog circuits. Additionally, scaling the analog circuits from one generation of process technology to the next brings its own set of complications.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Newer process technologies enable circuits that utilize high speed transistors. The high-speed character of the transistors may be utilized to achieve higher-resolution switched digital regulators that have fast cross corner and variable temperature response, with constrained ripple. The strength of the power transistors utilized by the regulator are adjusted to control the current delivered to the load. A variety of techniques are disclosed that utilize a slow control loop in parallel with a primary fast switching loop, in which the slow control loop responds more slowly to changes in the load current than does the fast control loop. The slow loop uses the switching signal of the primary loop to estimate the load current and set the power transistor size accordingly.

Figure 1:
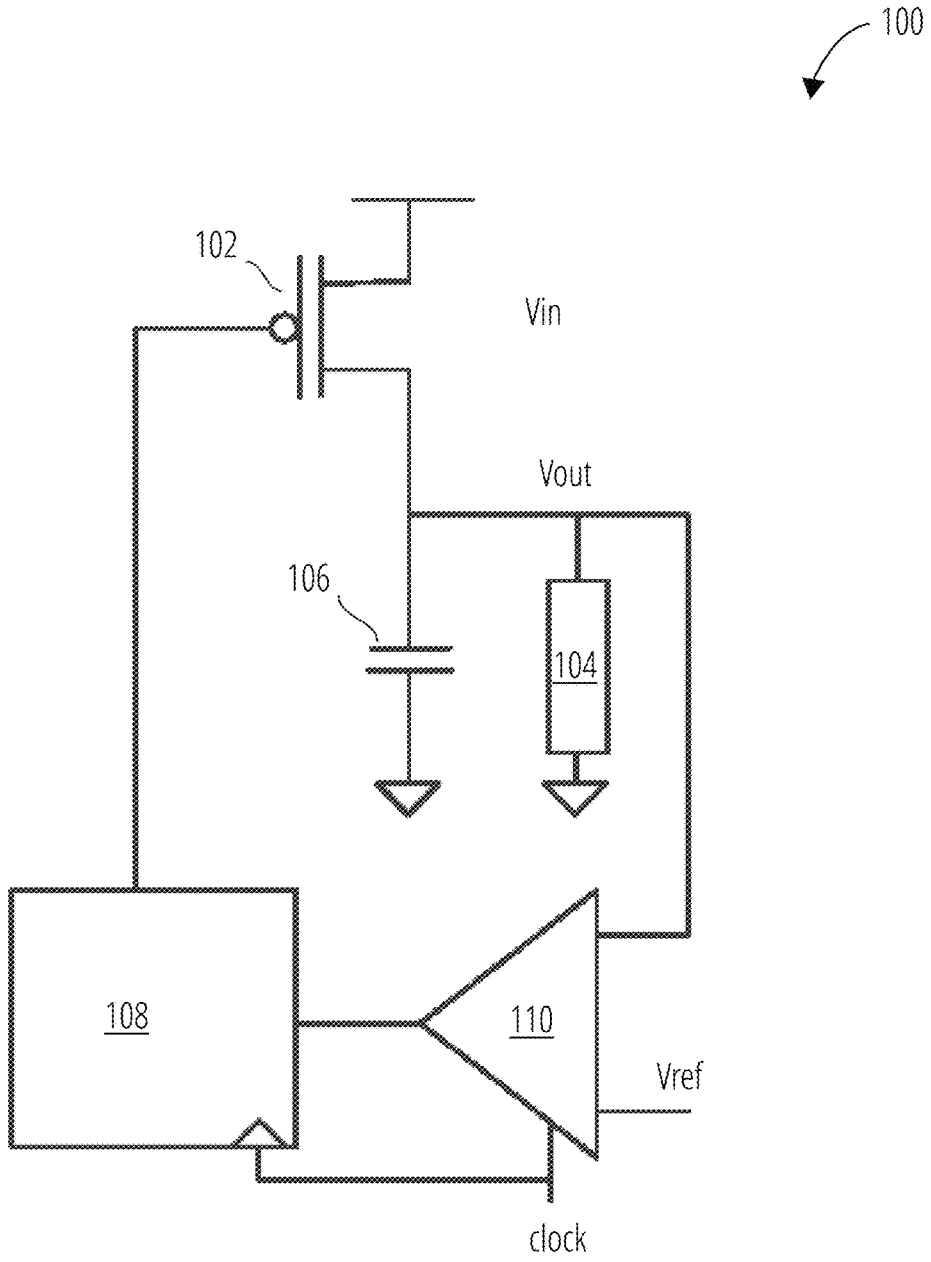
FIG. 1 illustrates a switched low-dropout regulator 100 in accordance with one embodiment.

A digital switched low-dropout regulator 100 for a load 104 is shown in FIG. 1. The comparator 110 compares the output voltage Vout with Vref. Vout is generated at the load 104 in parallel with the output decoupling capacitor 106.

There are different options as to how the comparison can be performed. The controller 108 can be a lower bound hysteretic control 200 (see FIG. 2) where Vout is compared with Vref and whenever Vout drops below Vref one or more power transistor 102 is turned ON for a fixed time interval. Alternatively the controller 108 can be bang-bang hysteretic control 300 (see FIG. 3) where Vref_high and Vref_low are generated from Vref and compared with Vout. When Vout falls below Vref_low, the power transistor 102 is turned ON to transfer charge from the Vin power supply. The power transistor 102 is turned OFF when Vout goes above Vref_high.

Figure 2:
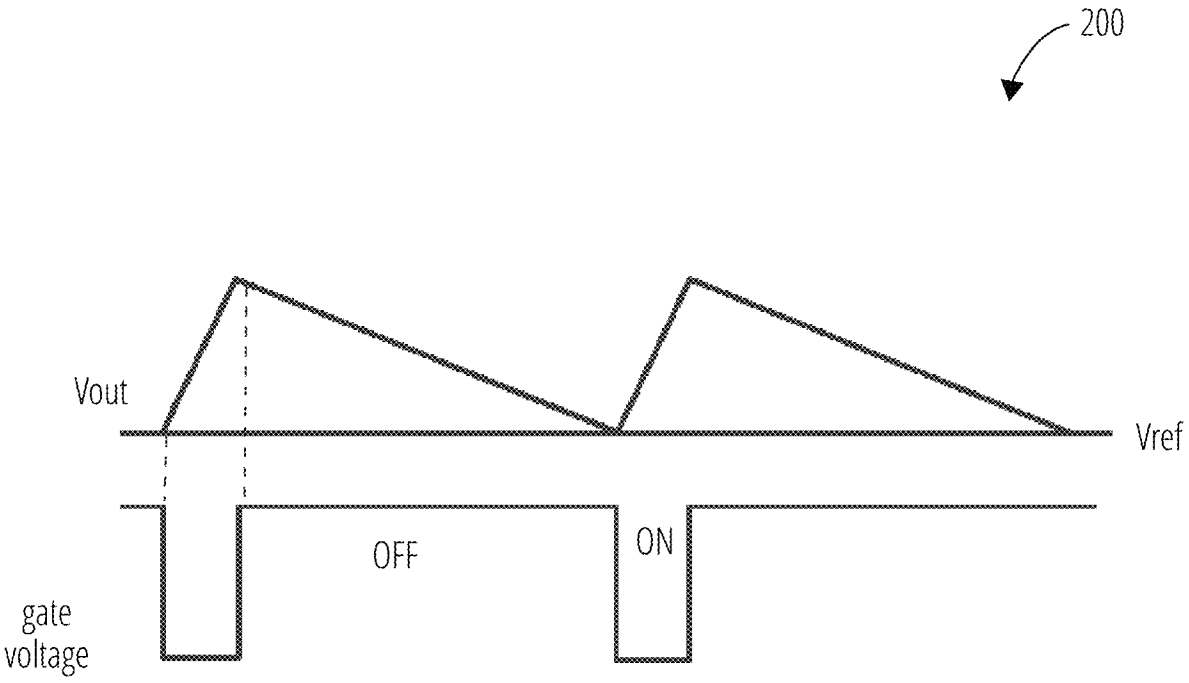
FIG. 2 illustrates a lower bound hysteretic control 200 in accordance with one embodiment.
Figure 3:
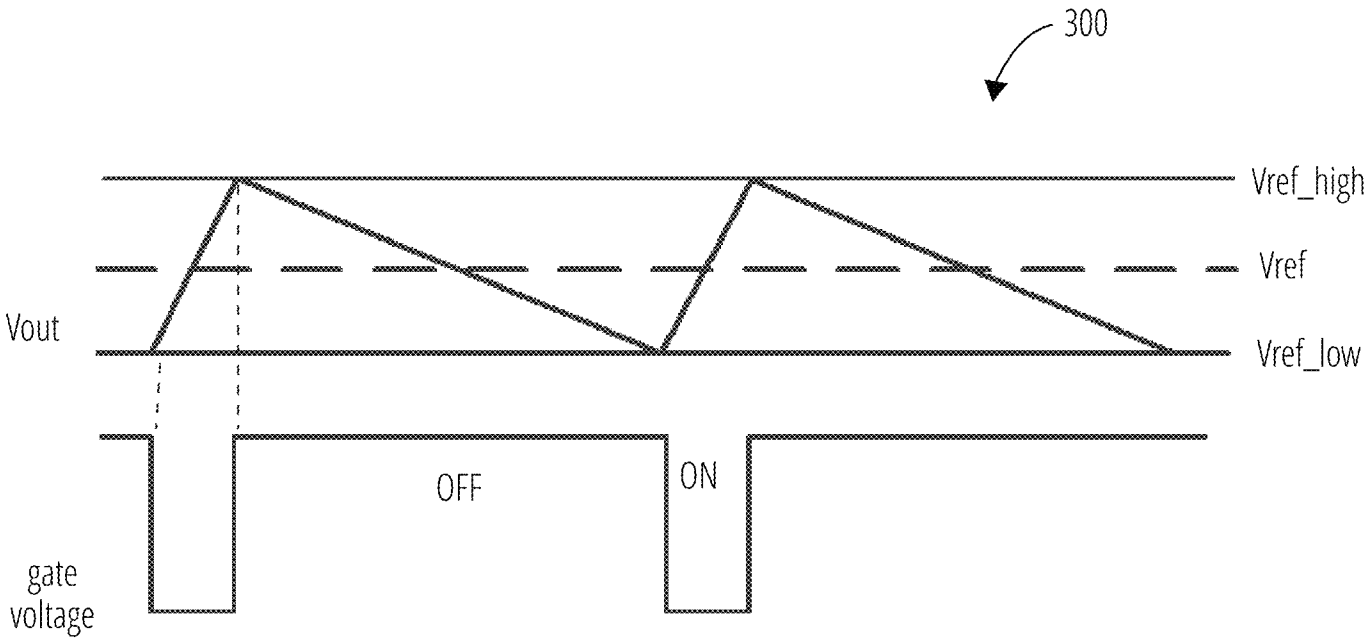
FIG. 3 illustrates a bang-bang hysteretic control 300 in accordance with one embodiment.

In the lower bound hysteretic control 200 of FIG. 2, when Vout is lower than Vref, the comparator 110 is turned ON for a preset time interval. During this preset time interval charge is transferred from the Vin power supply and stored on the output decoupling capacitor 106, which sustains Vout while the gate voltage has the power transistor 102 turned OFF. The size of the power transistor 102 is calculated at the slowest corner, maximum temperature, highest current and lowest dropout voltage for the implementation. A size for the power transistor 102 selected in this fashion leads to the transfer of excess charge from the Vin power supply at the fast corner, low temperature, lowest current and highest dropout voltage. This excess charge is transferred to the output decoupling capacitor 106 and causes voltage ripple on Vout (i.e. overshoot). A dynamic scheme is thus needed to control the amount of charge transferred to the output decoupling capacitor 106 during the ON time.

The bang-bang hysteretic control 300 may incur the same issues with excess charge transfer as the lower bound hysteretic control 200. A bang-bang control comparator may be analog or digital in nature. If analog, the delay in the analog comparator determines the minimum ON and OFF times. Depending on the strength of the power transistor, this may be excessive and hence result in over-charging. If a digital comparator is implemented the clock period determines the minimum time before the comparator flips from one state to another and again depending on the strength of the power transistor, this may result in overcharging above the Vref_high limit.

Figure 4:
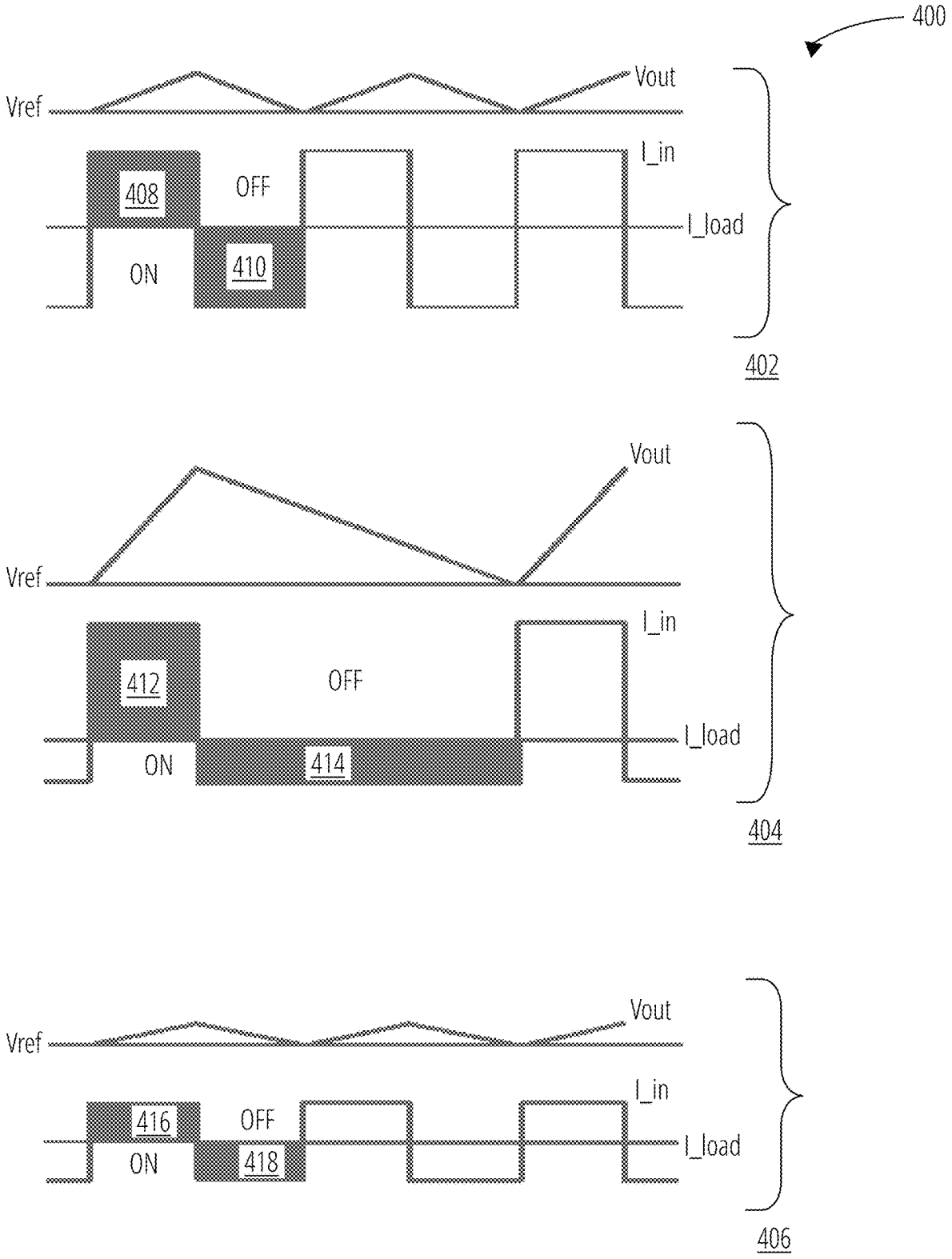
FIG. 4 illustrates an input current waveforms 400 in accordance with one embodiment.

Referring to the exemplary input current waveforms 400 of FIG. 4, the charge transferred from Vin to the output decoupling capacitor 106 sustains the output voltage when the power transistor 102 is turned OFF. The OFF time is determined by the current in excess of the load current, which is transferred from the Vin power supply, during the ON time. For example, if the input current is twice the load current during the ON time, then (OFF time)=(ON time) as shown for the high load condition 402, with the area 408 and area 410 being equal. This equal area condition holds true for the area 412 and the area 414 of the input current same input current and low load condition 404.

For the same input current and low load condition 404, when the load current is reduced, the input current is kept constant as in the maximum load case. This results in large output voltage (Vout) ripple. If the input current is reduced in conjunction with load current changes, this voltage ripple may be significantly reduced as shown for the reduced input current and low load condition 406, for which the area 416 and the area 418 are also the same. The separation of the ON pulses for the power transistor 102 is an indication of the strength of the power transistor 102 in relation to load current. Strength herein refers to the amount of pass current output from the power transistor when it is turned ON. Larger current is greater power transistor strength.

If more current is delivered when the transistor is ON then the load voltage overcharges and hence takes a longer time to discharge below Vref which will make the switching pulses of the fast control loop spread wide apart. On the other hand, if the strength of the power transistor 102 is lowered then the overcharging will be lower and hence for a given load current, Vout will discharge below Vref faster and the switching pulses of the fast control loop will be less separated. In the disclosed embodiments the separation between the switching pulses is used as an indirect measure of how much pass current is provided by the power transistor 102, instead of measuring the pass current directly.

The separation between the ON pulses may be detected by a digital circuit. Based on this separation of the ON pulses, the strength of the power transistor 102 may be incremented or decremented. A band of acceptable separation between the pulses may be set to configure the strength control in order to attain a stable point of operation. The strength control loop comes into use only when there is a preconfigured threshold change in load current over a preconfigured time interval. Minor changes in magnitude and rate of change of the load current are managed by the fast switching loop.

Figure 5:
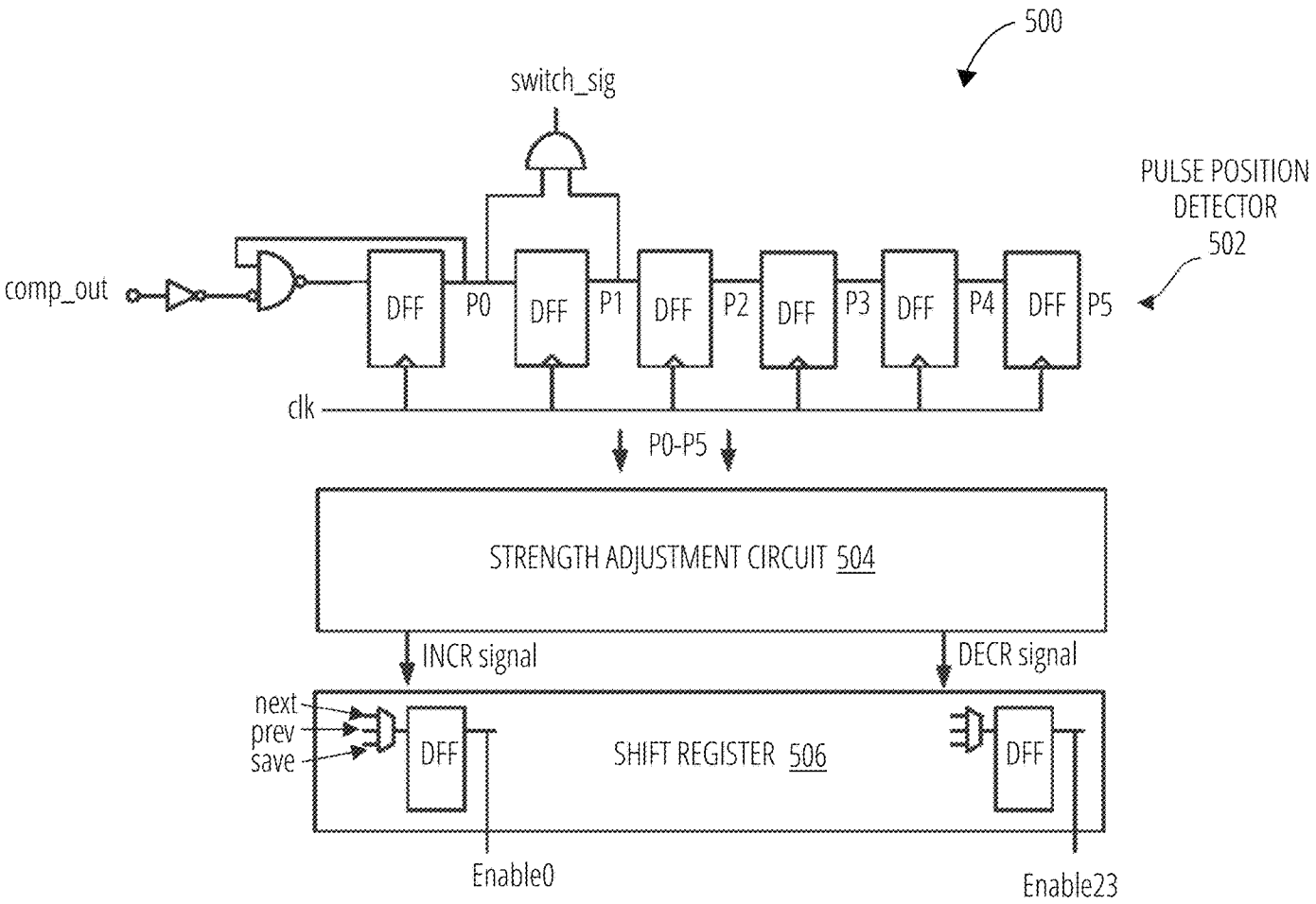
FIG. 5 illustrates a strength controller 500 in accordance with one embodiment.

An embodiment of a strength controller 500 is shown in FIG. 5. The main elements of the strength controller 500 are 1. Pulse position detector 502
2. Strength adjustment circuit 504
3. Shift register 506 (or other memory)

The pulse position detector 502 comprises a flip-flop chain of D flip-flops (DFFs) or other memory, which are clocked by the system clock (clk), with the comparator 110 output (comp_out) as the input. The flip-flop chain stores a sequence of values (P0-P5) of the comparator 110 output which are applied to calculate whether to increment or decrement the strength of the power transistor 102.

Figure 6:
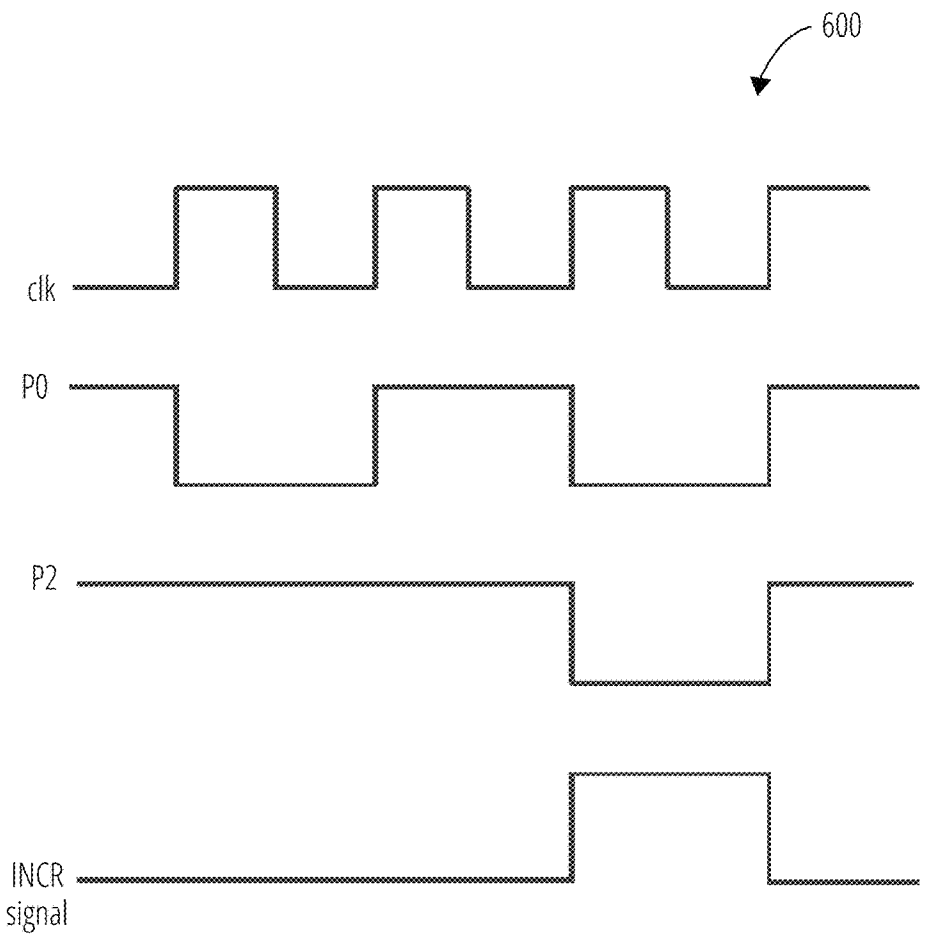
FIG. 6 illustrates an INCR signals 600 in accordance with one embodiment.
Figure 7:
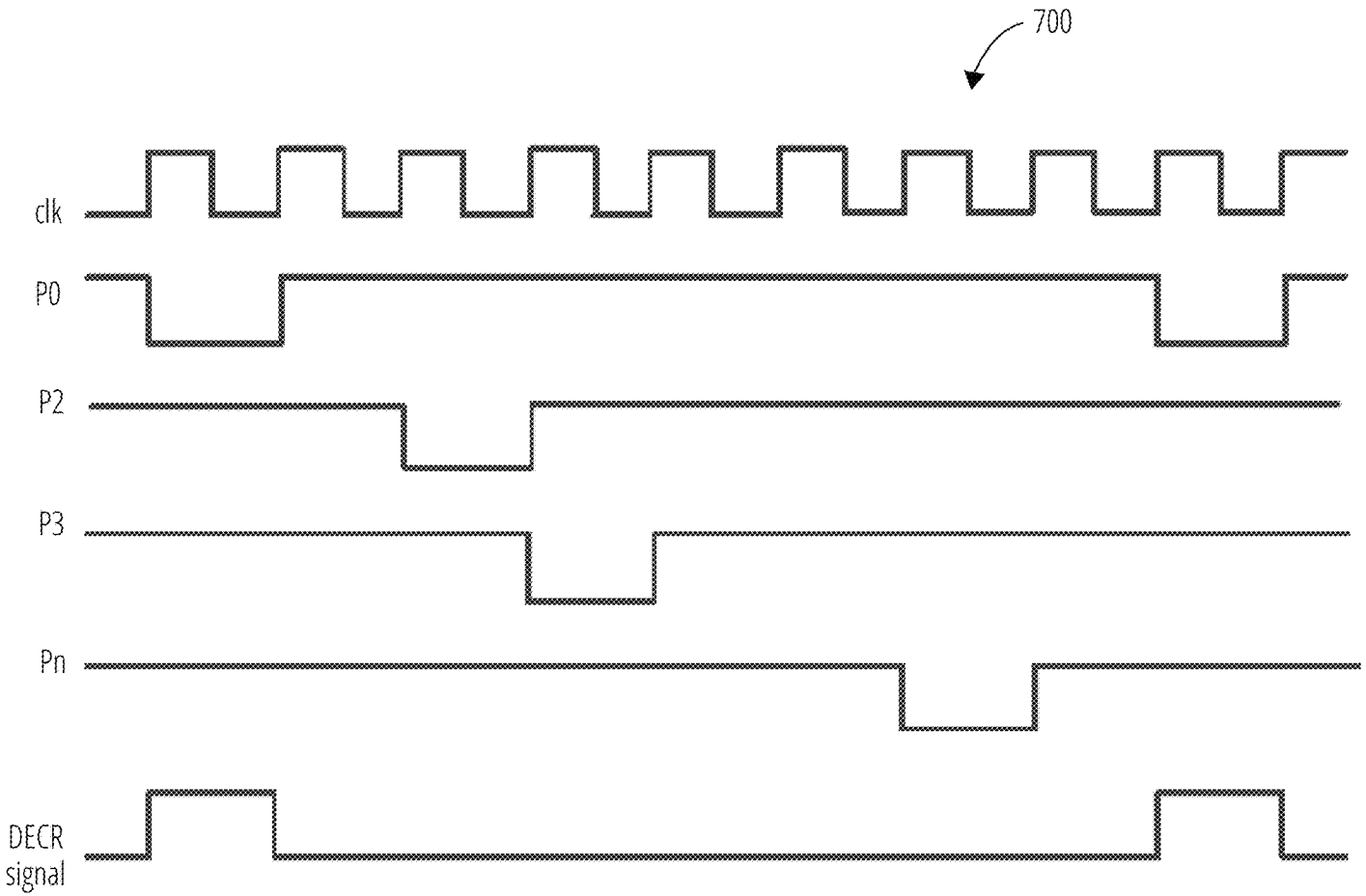
FIG. 7 illustrates a DECR signals 700 in accordance with one embodiment.

The strength adjustment circuit 504 looks at the position of two ON pulses of the comparator 110 output and if the pulses are located too close to one another, the INCR signal is asserted. If the pulses are too far apart then DECR signal is asserted. If the separation of the pulses is within a configured acceptable separation range, then previous value of the comparator 110 output is maintained. This behavior is illustrated in the exemplary INCR signals 600 of FIG. 6 and the exemplary DECR signals 700 of FIG. 7. This separation range may be configured to set the control window suitable to the implementation.

In one embodiment the logic to determine the INCR signal is as follows:

```
if (P0==0) && (P2==0) then
INCR signal = 1 (asserted)
else
INCR signal = 0 (not asserted)
```

In one embodiment the logic to determine the DECR signal is as follows:

```
    if (P0==0) && (P2==1) && (P3==1) && (P4==1) && (P5==1)
then
    DECR signal = 1 (asserted)
    else
    DECR signal = 0 (not asserted)
```

The shift register 506 stores, in one embodiment, a thermometer encoded strength control signal. If the INCR signal is asserted, then '1' is pushed into the shift register 506 from the left side of the shift register 506 to increase the strength of the power transistor 102 by one unit. Alternatively, if the DECR signal is asserted then a '0' is pushed in from the right side of the shift register 506 to decrease the strength of the power transistor 102 by one unit. If both the signals are de-asserted, then the previous strength value of the power transistor 102 becomes the current strength value of the power transistor 102. The power transistor 102 can be segmented into equal sized blocks, which in one embodiment are equal-sized sub-transistors arranged in parallel, together comprising the overall power transistor 102. The thermometer encoded strength control signal can be combined with the switching signal to either switch the power transistor 102 ON or keep it/them always OFF as shown in the exemplary power transistor gate driver circuit 800 of FIG. 8.

Figure 8:
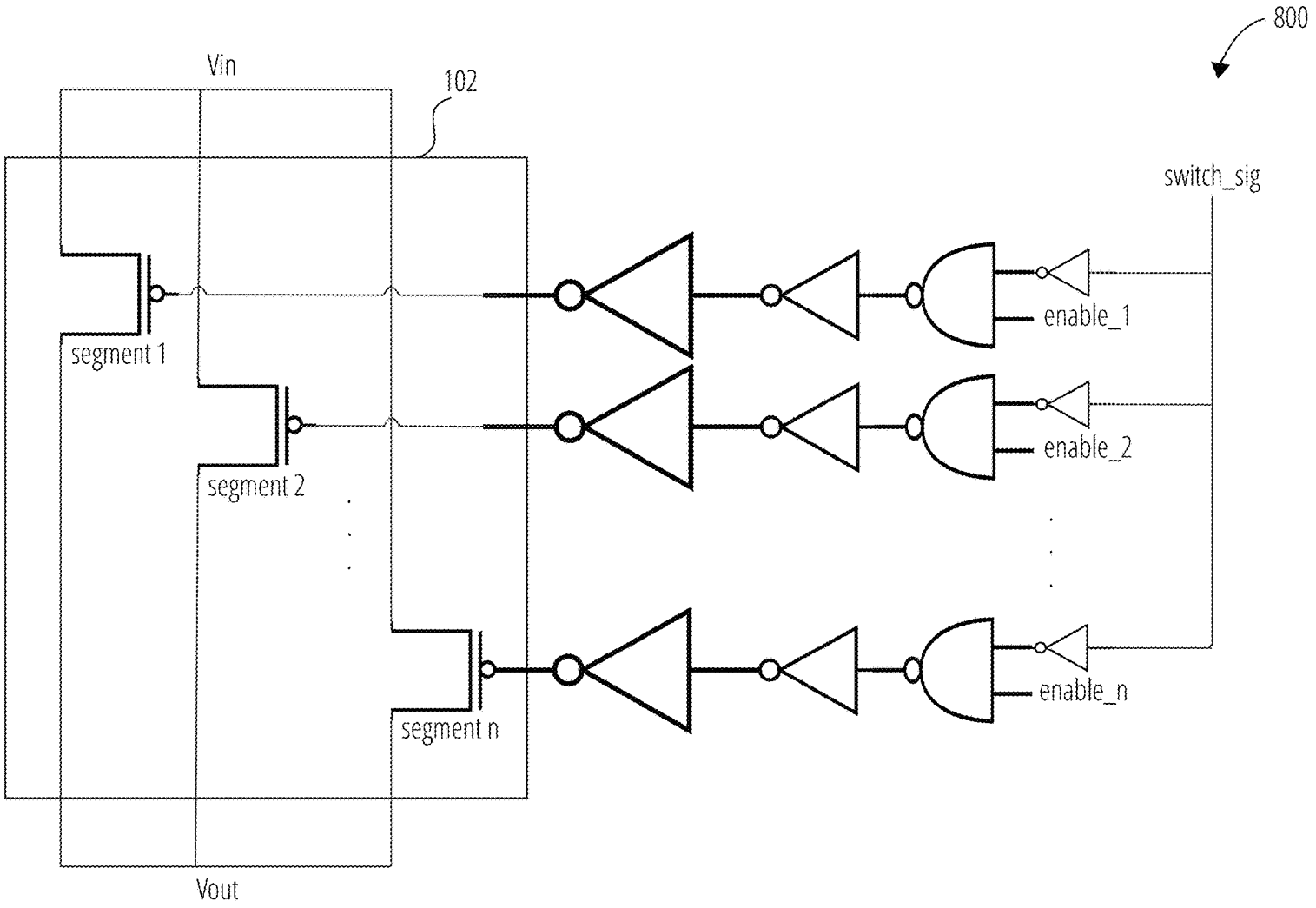
FIG. 8 illustrates a power transistor gate driver circuit 800 in accordance with one embodiment.

In one embodiment the power transistor 102 is segmented into 24 transistors in parallel. FIG. 8 illustrates these segments. Segment 1 may receive enable_1, segment 2 may receive enable_2 so on and so forth. One enable value from the shift register 506 is provided to each segment. When enable_n is '1' segment n is enabled and the corresponding sub-transistor passes current. When enable_n='0' the corresponding segment does not pass current.

The different illustrated sizes of the inverters in FIG. 8 indicate increasing circuit size. For example the inverter sizes may increase sequentially by a factor of three, or to save power a scaling of six may for example be utilized.

Figure 9:
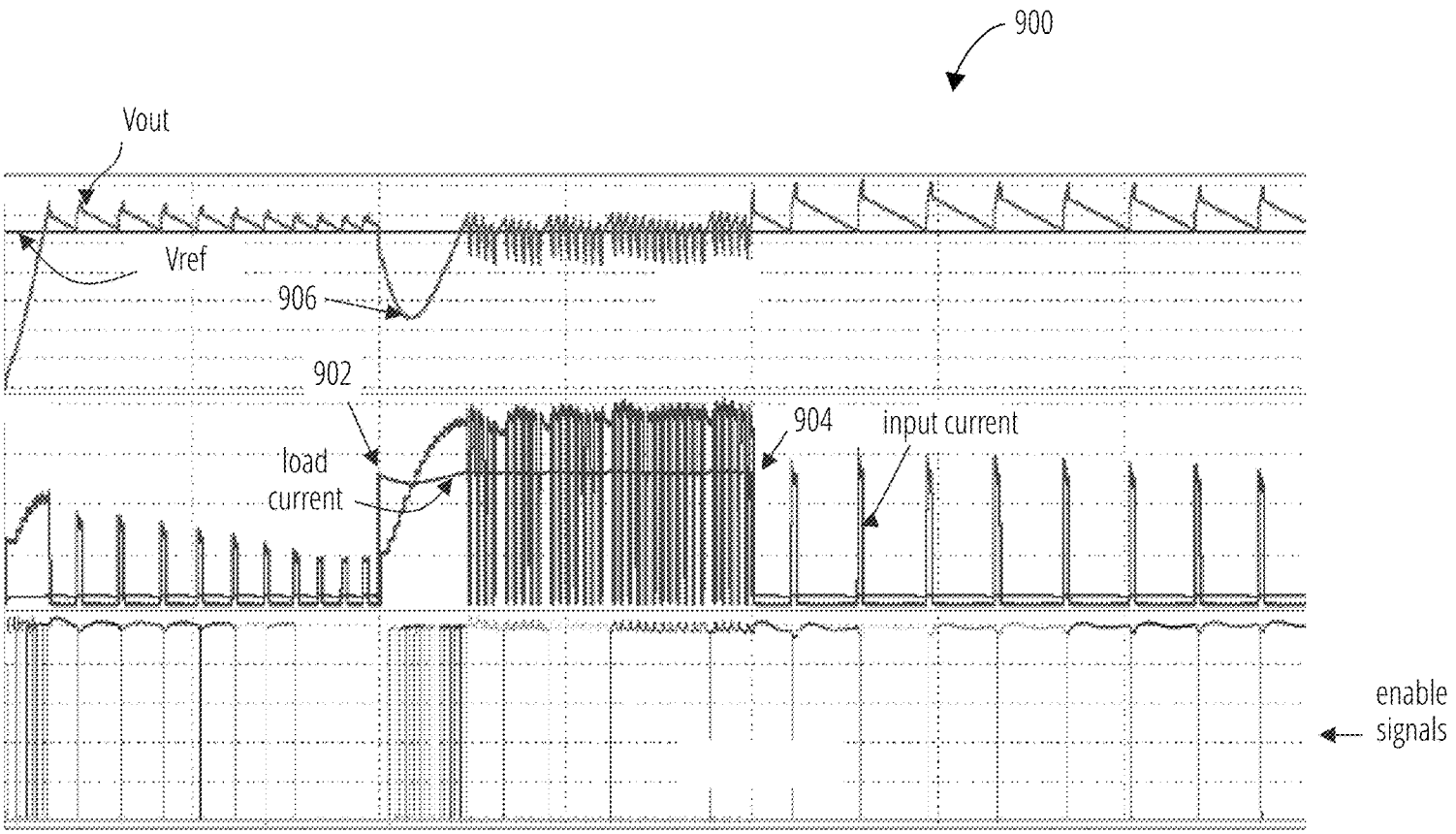
FIG. 9 illustrates a strength control adjustment waveform 900 in accordance with one embodiment.

The strength control adjustment waveform 900 of FIG. 9 shows the input current being adjusted for the low load condition to high load condition transition 902, and for the high load condition to low load condition transition 904. The adjustment in the strength control loop is faster for the low load condition to high load condition transition 902 because every time pulses are detected too close together, the INCR signal is asserted. However, for the transition from the high load condition to low load condition transition 904, the DECR signal is asserted only when a certain time interval separates the pulses. There is a droop 906 for the low load condition to high load condition transition 902 as the strength controller 500 adjusts. The combined values of the enable signals (enable0 and enable23) from the shift register 506 are referred to herein as the strength code.

Figure 10:
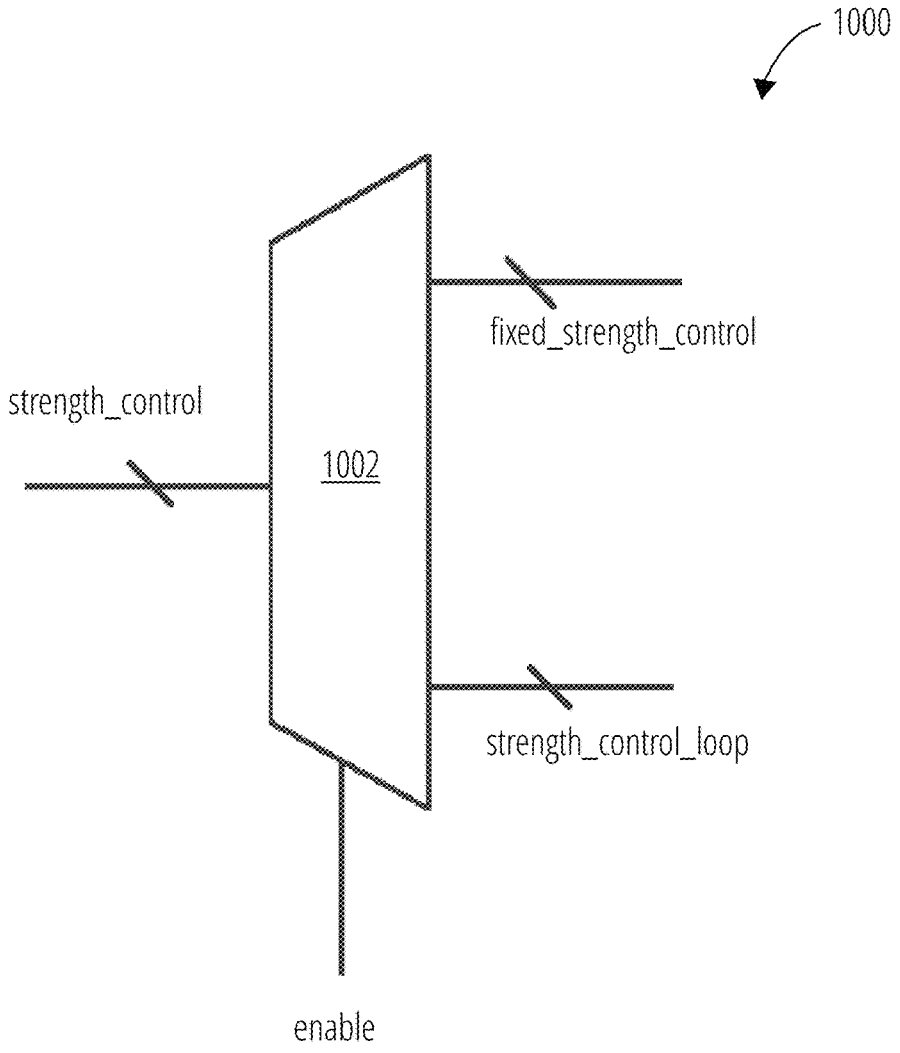
FIG. 10 illustrates a strength control selector 1000 in accordance with one embodiment.
Figure 11:
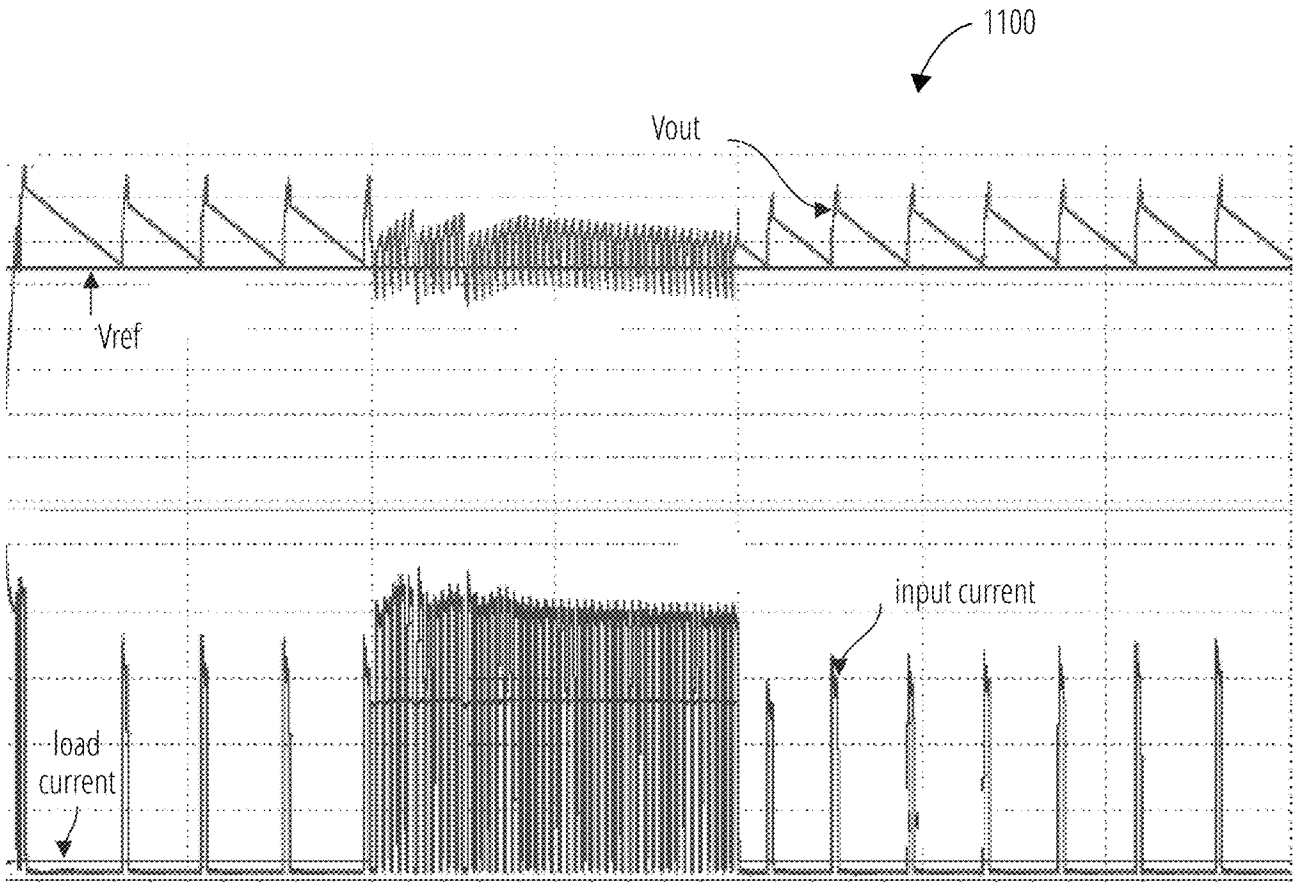
FIG. 11 illustrates a waveforms with fast response enabled 1100 in accordance with one embodiment.

Referring to the strength control selector 1000 of FIG. 10, in some embodiments a fast transition response between the low load condition to high load condition transition 902 may be required, and only a limited droop 906 can be tolerated. One such embodiment is a fast wake-up of a transceiver link from a low power state. In this case the strength control loop may be disabled and a fixed strength code may be configured. In the digital domain this may be implemented using a multiplexer 1002 to select whether the strength code generated by strength control loop controls the switch strength, or whether a fixed strength code controls the switch strength, as shown in FIG. 10. The fixed strength code that is utilized needs to enable the maximum load current demand by the load 104. This prevents the droop 906 on Vout even in the presence of a large load change, as shown in the example of waveforms with fast response enabled 1100 of FIG. 11. However, because the input current no longer tracks the load current, higher ripple occurs for the low load condition. Depending on the application, the strength controller 500 may be configured for low ripple or fast transient response. By selecting a fast response to the low load condition to high load condition transition 902, the droop 906 is substantially reduced or eliminated.

Figure 12:
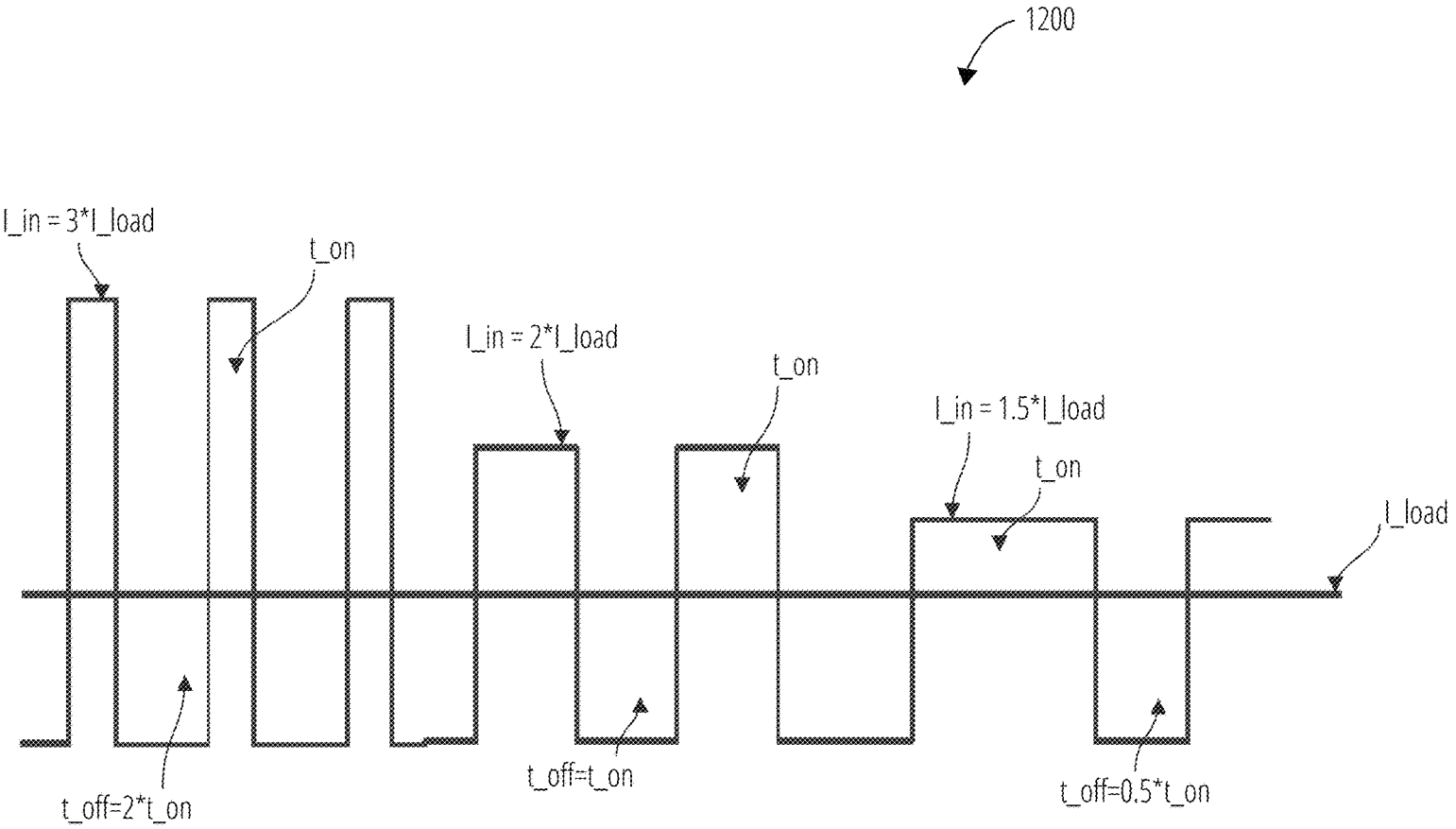
FIG. 12 illustrates an input current waveform 1200 in accordance with one embodiment.

Alternatively, the gate voltage can be adjusted to set the input current. For a hysteretic comparator controlling a low dropout regulator, the ON-OFF time of the gate voltage has a definite relation with the input current as illustrated in the example input current waveform 1200 of FIG. 12.

Figure 13:
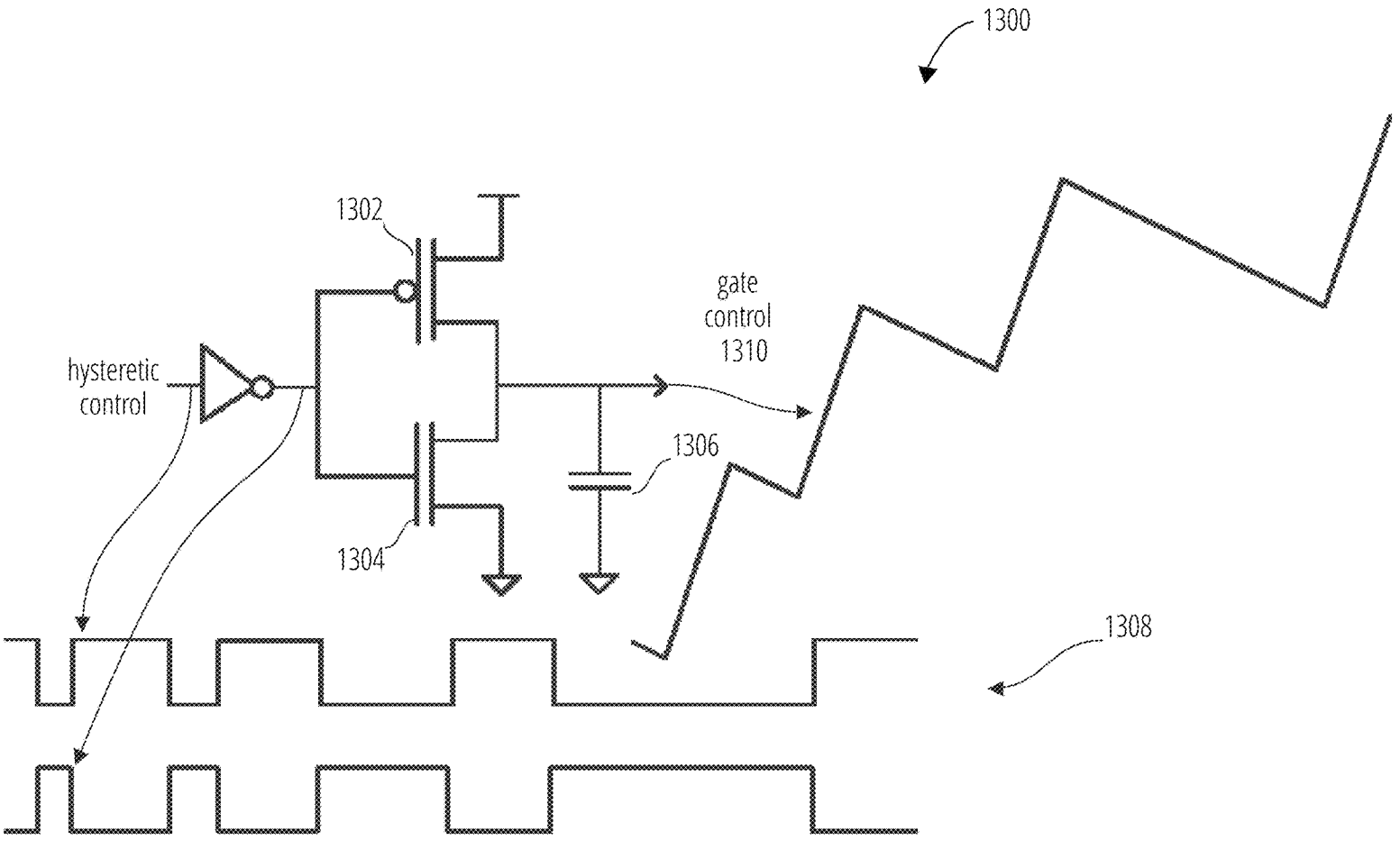
FIG. 13 illustrates a gate voltage generation for a power transistor 1300 in accordance with one embodiment.

Timing information may be converted to a gate voltage control as shown by the gate voltage generation for a power transistor 1300 of FIG. 13. This is accomplished using charge-discharge current pulses 1308 to charge the voltage of a filter capacitor 1306 UP or DOWN. The filter capacitor 1306 low pass filters the charge-discharge current pulses 1308. An equilibrium point is reached when the charge being injected into the filter capacitor 1306 is equal to the charge leaking out of the filter capacitor 1306. By adjusting the relative duration of the charge-discharge current pulses 1308 the ON and OFF time can be adjusted, which in turn adjusts the strength of the power transistor 102 as shown in the FIG. 13. The sizes of the transistors may be set to the ratio: size(PMOS transistor 1302)=4*size(NMOS transistor 1304). In order to achieve equilibrium, the voltage on the filter capacitor 1306 increases until the switching time is such that the ON time is four times the OFF time.

Figure 14:
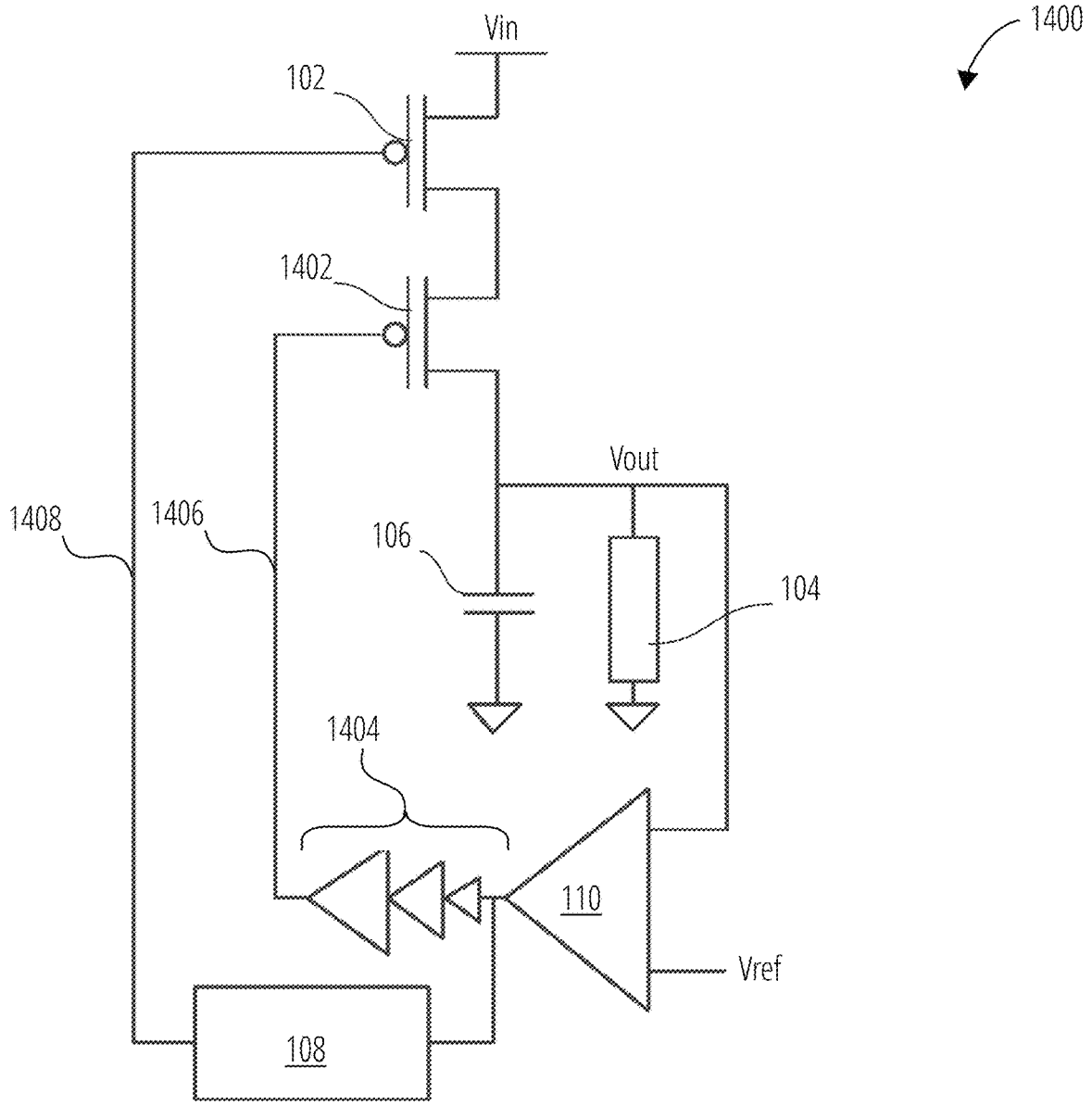
FIG. 14 illustrates a switched low-dropout regulator 1400 in accordance with one embodiment.

The generated gate voltage 1310 may be applied via a delay circuit 1404 to a control transistor 1402 that is connected in-series with the switching power transistor 102 as shown in the switched low-dropout regulator 1400 embodiment of FIG. 14. This signal may act as the fast switching loop 1406, first control loop, or first feedback loop of this disclosure. The path from the controller 108 to the power transistor 102 may act as the slow control loop 1408, second control loop, or second feedback loop disclosed herein. The size of the control transistor 1402 and the power transistor 102 may be doubled from the value of power transistor 102 in FIG. 1 in this embodiment, because the transistors are connected in series.

Figure 15:
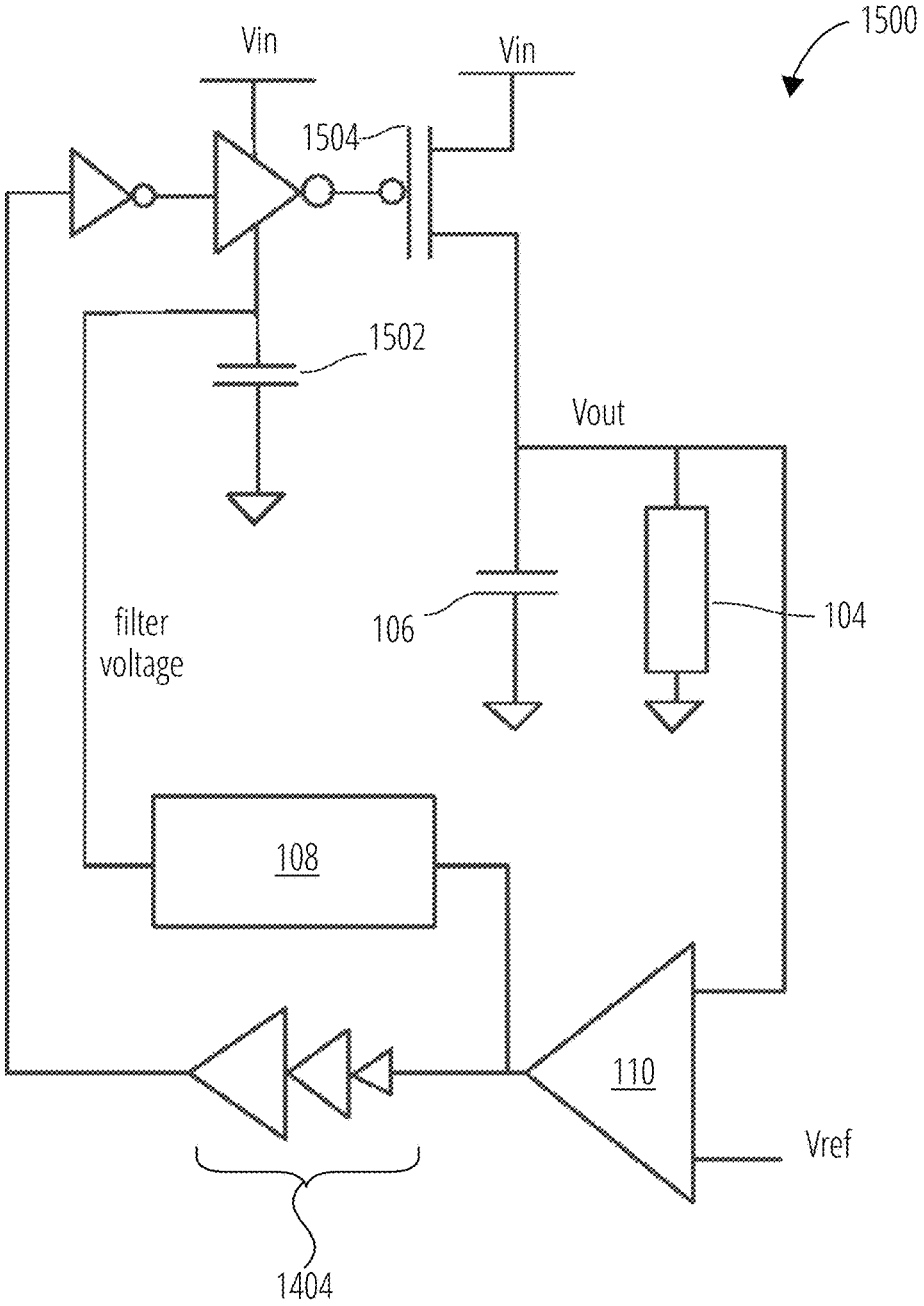
FIG. 15 illustrates a switched low-dropout regulator 1500 in accordance with one embodiment.

In one embodiment, the control transistor 1402 and the power transistor 102 are combined into a transistor 1504 to reduce the size of the switching circuit by half, as shown in the switched low-dropout regulator 1500 embodiment of FIG. 15. This reduces switching power loss. The gate of the filter capacitor 1502 is not switching between VDD and GND, but between VDD and some intermediate voltage determined by the equilibrium state of the filter capacitor 1502, which further saves switching power.

Any even number of inverters may be utilized depending on the size of transistor 1504. The size increment may increase in the ratio 6:1 from a setting determined by the transistor 1504. For example if the transistor 1504 has a size of 36 units then the inverter immediately to its left in FIG. 15 may have a size of six units. The first inverter may then be one unit in size. If transistor 1504 has a size of 1536 units then the inverters preceding it will be sized 256 units, 36 units, six units, and 1 unit.

Figure 16:
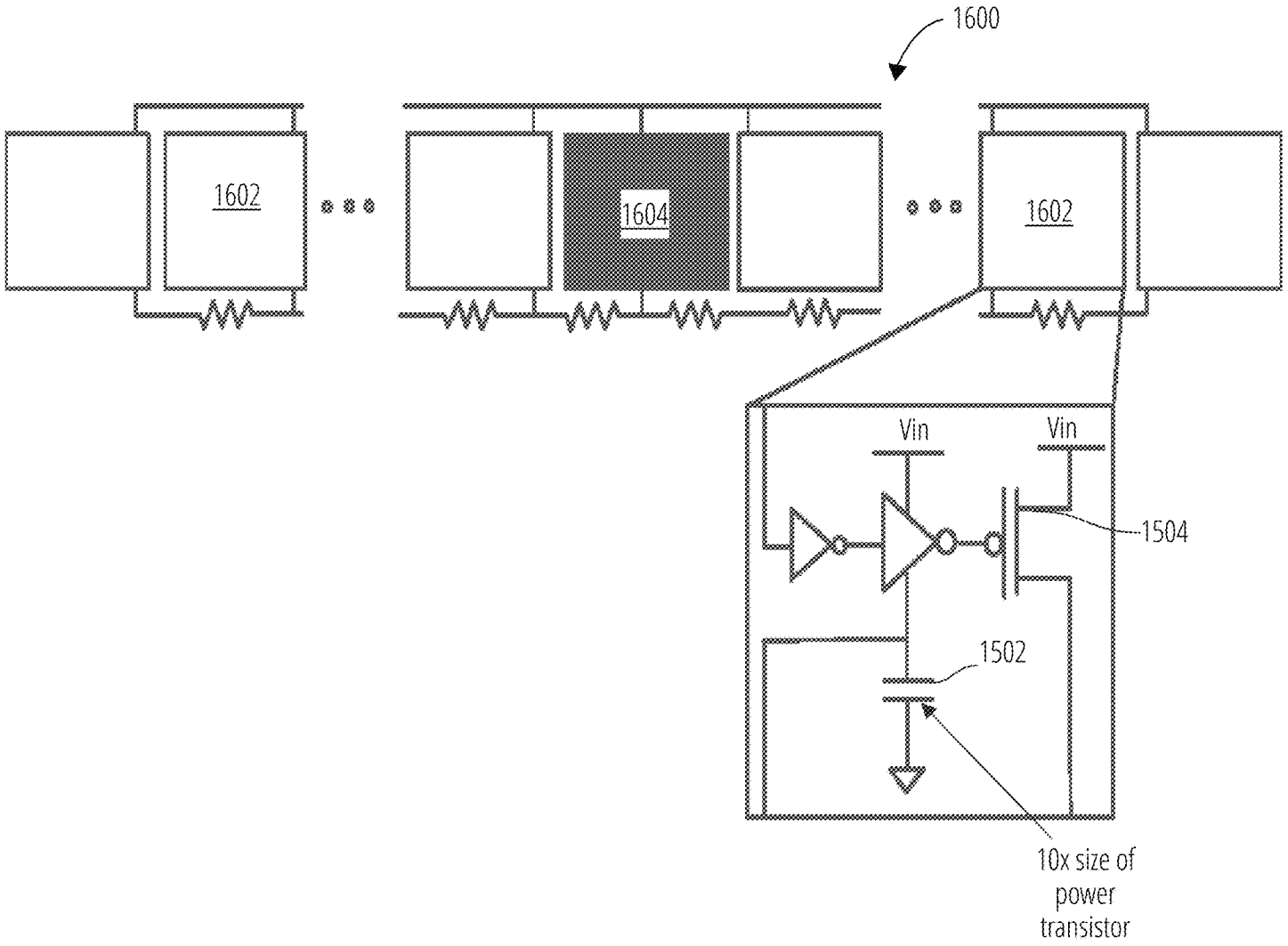
FIG. 16 illustrates a circuit layout 1600 in accordance with one embodiment.

From a layout perspective, thick top metal routing may be utilized, shielded using VDD and GND lines. The filter capacitor 1502 may be located in the switch unit cell 1602 (different than the controller unit cell 1604) closest to the transistor 1504 which will provide some noise immunity as shown in the circuit layout 1600 embodiment of FIG. 16.

Figure 17:
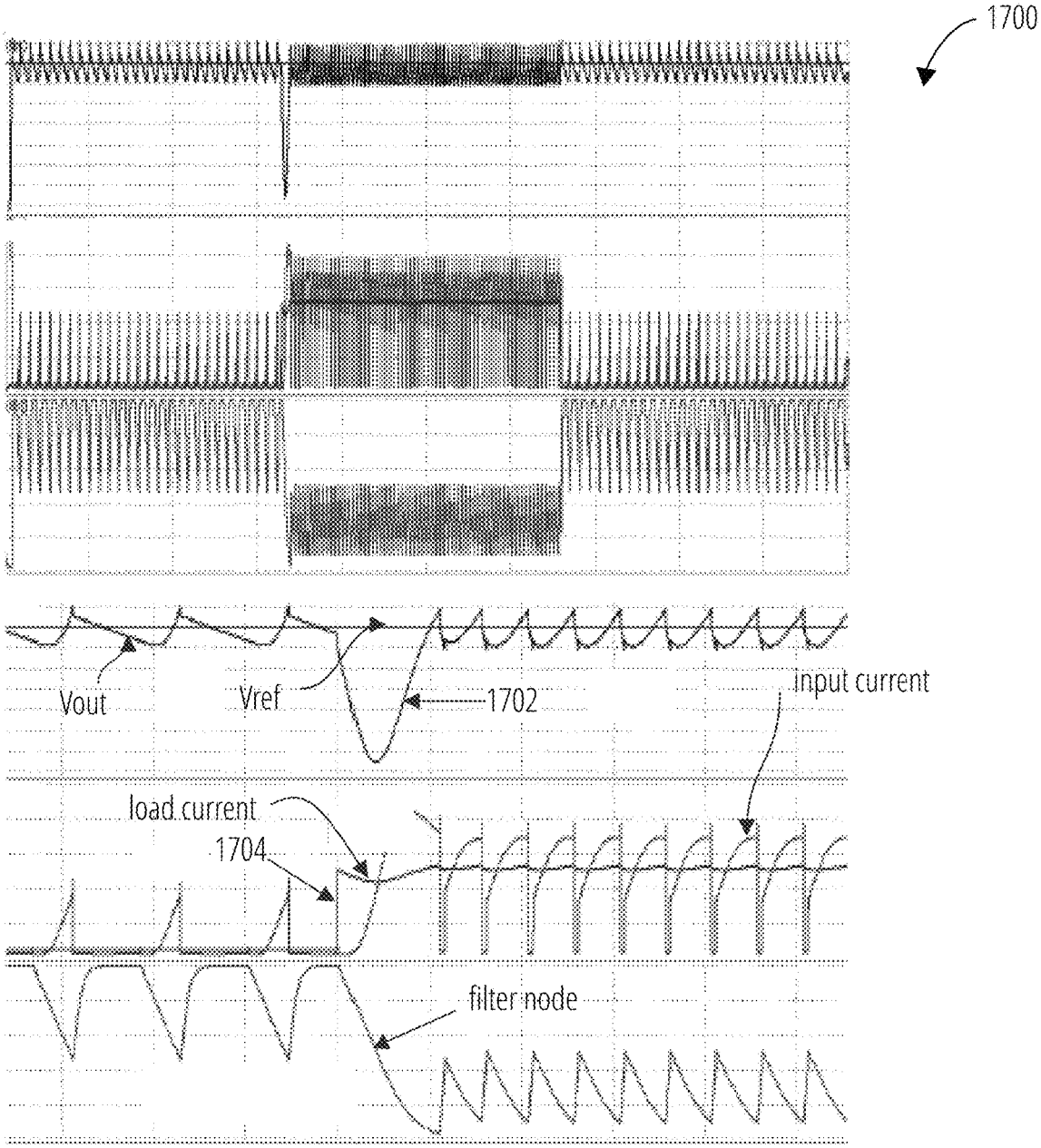
FIG. 17 illustrates an analog voltage control simulation 1700 in accordance with one embodiment.

FIG. 17 illustrates an embodiment of an analog voltage control simulation 1700 for the load current. The droop 1702 due to the low load condition to high load condition transition 1704 is 132 mV which recovers in 10 ns. The steady state ripple is 40 mV. The voltage on the filter capacitor (filter node) is also shown.

Figure 18:
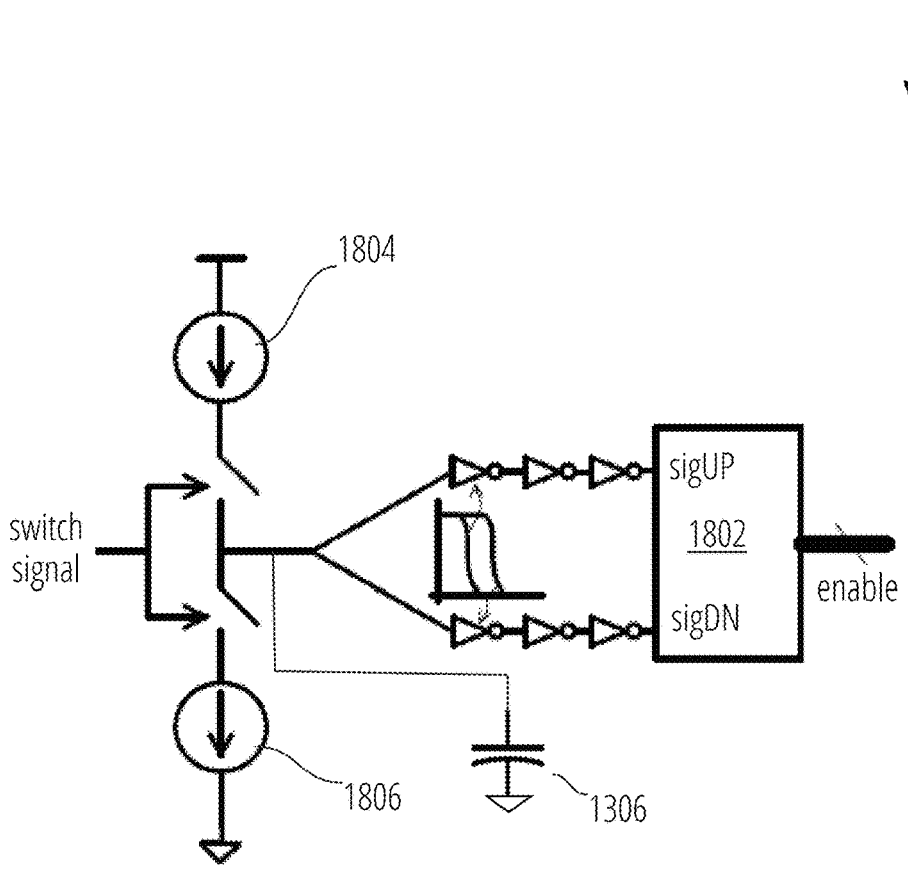
FIG. 18 illustrates a digital control device 1800 in accordance with one embodiment.

The control of the ON and OFF time of the charge-discharge current pulses 1308 may be digitized so that the complications associated with transmission of analog signals is avoided. Referring to FIG. 18, one embodiment of a digital control device 1800 utilizes a counter 1802 to adjust, up or down, the required strength of the power transistor 102. The signal to count up (sigUP) or down (sigDN) is generated by a combination of UP-DOWN current sources (first current source 1804 and second current source 1806) and a filter capacitor 1306 with the current sources appropriately sized to cause the voltage on the filter capacitor 1306 to settle at a desired value. The output of the filter capacitor 1306 is applied to two inverter chains which are skewed in the opposite direction.

The value output from the lower inverter chain is compared with the value output from the upper inverter chain. There may be any number of inverters in each chain, provided there are the same number of inverters in both chains.

In one embodiment each inverter comprises a PMOS and an NMOS transistor. If both of these are of the same size then when the input voltage to the inverter crosses the half the supply voltage, the output of the inverter switches, and the mid-point of the supply voltage is the inverter output transition point. An inverter may be skewed to change the transition point. For example making the PMOS transistor of the inverter twice the size of the NMOS transistor moves the transition point of the inverter higher than half the supply voltage. If the NMOS transistor size is made twice the size of PMOS transistor then the transition point of the inverter will be less than half the supply voltage. Skewing the chains in the opposite direction means that in one of the chains, the NMOS transistors have a larger size than the PMOS transistors, and vice versa for the other chain.

In one embodiment the counter 1802 implements the algorithm below.

```
If ((sigUP == 1) && (sigDN == 1))
count = count + 1;
```

-continued

```
Else if ((sigUP == 0) && (sigDN == 0))
count = count − 1;
```

Figure 19:
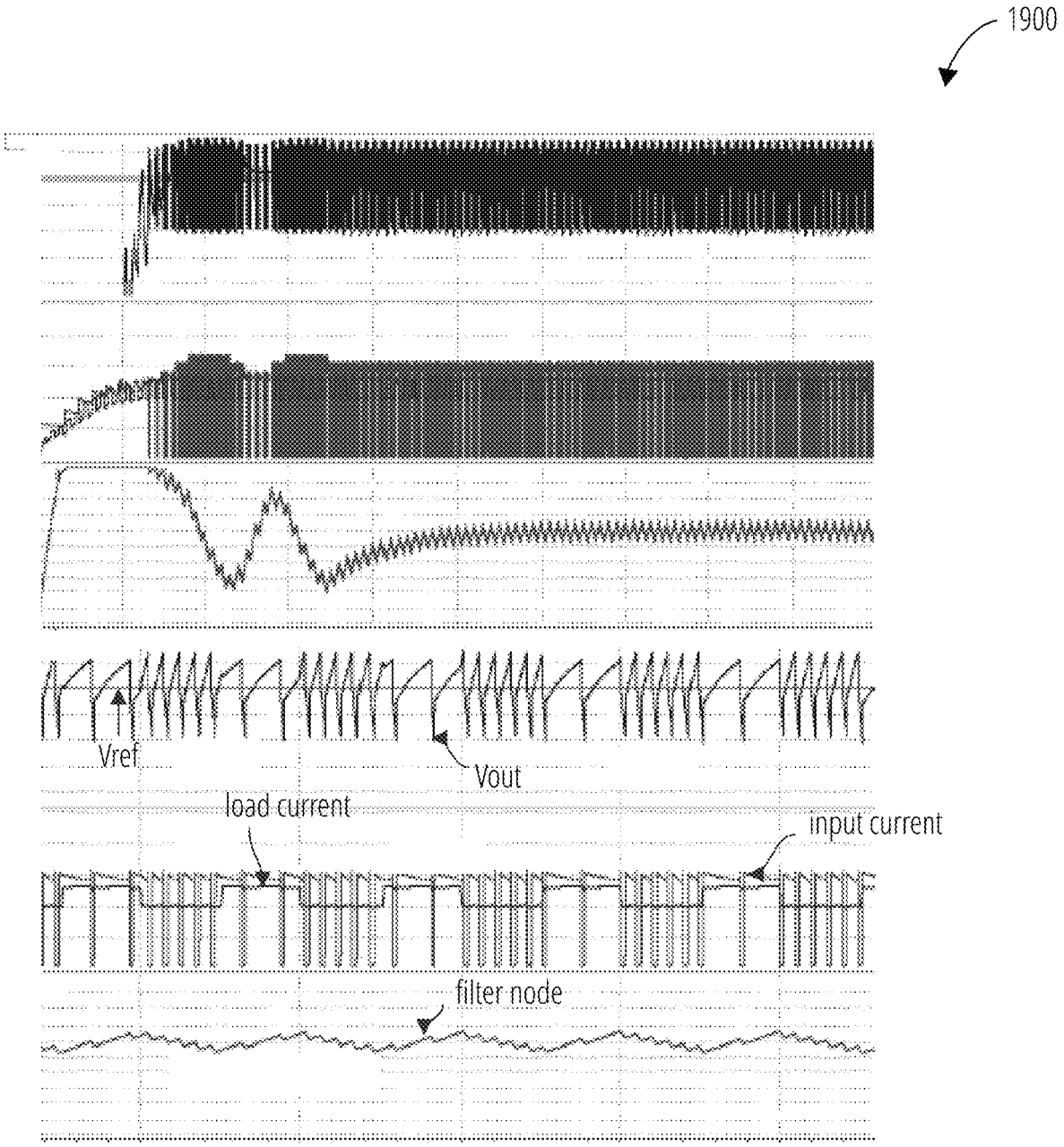
FIG. 19 illustrates a waveforms 1900 in accordance with one embodiment.

Under equilibrium condition the filter capacitor voltage settles in the region between the inverter threshold of the two skewed inverters. FIG. 19 illustrates exemplary waveforms 1900 resulting from this control technique.

Herein, references to "one embodiment" or "an embodiment" do not necessarily refer to the same embodiment, although they may. Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively, unless expressly limited to a single one or multiple ones. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list, unless expressly limited to one or the other. Any terms not expressly defined herein have their conventional meaning as commonly understood by those having skill in the relevant art(s).

Various logic functional operations described herein may be implemented in logic that is referred to using a noun or noun phrase reflecting said operation or function. For example, an association operation may be carried out by an "associator" or "correlator". Likewise, switching may be carried out by a "switch", selection by a "selector", and so on.

What is claimed is:

1. A voltage regulator comprising:

a single power transistor controlling a load current;

a fast switching loop;

a slow control loop generating a signal applied simultaneously with a signal of the fast switching loop to the at least one power transistor, the slow control loop responding more slowly to changes in the load current than the fast switching loop; and the slow control loop setting an intermediate voltage between a supply voltage and a ground voltage at a gate of the power transistor.

2. The voltage regulator of claim 1, wherein the slow control loop comprises a lower bound hysteretic control.

3. The voltage regulator of claim 1, wherein the slow control loop comprises a bang-bang hysteretic control.

4. A regulated power supply, comprising:

a power transistor comprising a gate driven by a control signal from a first control loop and a control signal from a second control loop;

the second control loop responding to a switching signal of the first control loop to determine a strength setting for the power transistor by setting an intermediate voltage between a supply voltage and a ground voltage at the gate of the power transistor; and the second control loop configured to respond more slowly than the first control loop to changes in a load voltage regulated by the power supply.

5. The power supply of claim 4, wherein the second control loop comprises a lower bound hysteretic control.

6. The power supply of claim 4, wherein the second control loop comprises a bang-bang hysteretic control.

7. The power supply of claim 4, wherein the first control loop and the second control loop are merged at inputs of an inverter, and an output of the inverter is applied to the gate of the power transistor.

8. A power supply comprising:

a single power transistor;

a first feedback loop from an output of the power transistor back to a gate of the power transistor, the first feedback loop comprising a voltage controller;

a second feedback loop signal from the output of the power transistor back to the gate of the power transistor; and wherein the first feedback loop and the second feedback loop are merged at inputs of an inverter, and an output of the inverter is applied to the gate of the power transistor.

9. The power supply of claim 1, wherein the fast switching loop and the slow control loop are merged at inputs of an inverter, and an output of the inverter is applied to the gate of the power transistor.

* * * * *